US009327155B2

(12) United States Patent
Doyle

(10) Patent No.: US 9,327,155 B2
(45) Date of Patent: May 3, 2016

(54) DEVICE AND METHOD FOR PERFORMING EXERCISES USING A FREELY ROTATING BALL

(76) Inventor: Brian Doyle, New York, NY (US)

( * ) Notice: Subject to any disclaimer, the term of this patent is extended or adjusted under 35 U.S.C. 154(b) by 164 days.

(21) Appl. No.: 13/876,598

(22) PCT Filed: Jun. 21, 2012

(86) PCT No.: PCT/US2012/043600

§ 371 (c)(1),
(2), (4) Date: Mar. 28, 2013

(87) PCT Pub. No.: WO2012/177918

PCT Pub. Date: Dec. 27, 2012

(65) Prior Publication Data

US 2013/0184131 A1 Jul. 18, 2013

Related U.S. Application Data

(60) Provisional application No. 61/499,240, filed on Jun. 21, 2011.

(51) Int. Cl.

| | |
|---|---|
| ***A63B 21/00*** | (2006.01) |
| ***A63B 22/18*** | (2006.01) |
| ***A63B 22/20*** | (2006.01) |
| ***A63B 23/035*** | (2006.01) |
| ***A63B 23/12*** | (2006.01) |
| ***A63B 26/00*** | (2006.01) |

(52) U.S. Cl.

CPC ..... *A63B 21/00* (2013.01); *A63B 22/18* (2013.01); *A63B 22/20* (2013.01); *A63B 23/0355* (2013.01); *A63B 23/1236* (2013.01); *A63B 26/003* (2013.01)

(58) Field of Classification Search

CPC .. A63B 22/18; A63B 26/003; A63B 23/1236; A63B 22/20; A63B 2225/62; A63B 41/00; A63B 2071/027; A63B 21/22; A63B 22/16; A63B 21/00; A63B 23/0355

USPC ..... 482/44–50, 95–96, 110, 131–133, 482/135–137, 139–142; 280/205

See application file for complete search history.

(56) References Cited

U.S. PATENT DOCUMENTS

| | | | | |
|---|---|---|---|---|
| 3,604,726 | A * | 9/1971 | Tracy | 280/205 |
| 3,716,229 | A | 2/1973 | Van Der Cleyen et al. | |
| 3,806,116 | A | 4/1974 | Malmberg et al. | |
| 3,895,794 | A | 7/1975 | England | |
| 4,191,371 | A | 3/1980 | Armer, Jr. | |

(Continued)

OTHER PUBLICATIONS

International Search Report dated Sep. 21, 2012.

(Continued)

*Primary Examiner* — Oren Ginsberg
*Assistant Examiner* — Jennifer M Deichl
(74) *Attorney, Agent, or Firm* — Tarter Krinsky & Drogin LLP

(57) ABSTRACT

Exemplary embodiments of an exercise apparatus and its method of use are provided. An exercise apparatus can be provided having a resilient ball configured to support a weight of a user performing exercises thereon, and a shell member configured to cover at least an upper portion of the resilient ball. The shell member can have an inner surface conforming to an outer surface of the resilient ball. A toroidal member can be provided that can be attached to the shell member and can surround a portion of the resilient ball.

21 Claims, 7 Drawing Sheets

(56) References Cited

U.S. PATENT DOCUMENTS

| | | | | |
|---|---|---|---|---|
| 4,509,743 | A | 4/1985 | Lie | |
| 4,759,542 | A | 7/1988 | Hudec | |
| 4,826,159 | A | 5/1989 | Hersey | |
| 5,092,586 | A | 3/1992 | Tuthill et al. | |
| 5,509,871 | A | 4/1996 | Giovanni | |
| 5,735,776 | A | 4/1998 | Swezey et al. | |
| 5,897,474 | A | 4/1999 | Romero | |
| D428,454 | S | 7/2000 | Fischer et al. | |
| 6,652,421 | B1 | 11/2003 | Chen | |
| 6,945,920 | B1 | 9/2005 | Kemery et al. | |
| D552,696 | S | 10/2007 | Hallar | |
| 7,300,392 | B1 | 11/2007 | Curran | |
| 7,357,767 | B2 | 4/2008 | Tsai | |
| 7,500,324 | B1 | 3/2009 | Power et al. | |
| 7,621,858 | B2 | 11/2009 | Sheron | |
| 7,632,218 | B2 | 12/2009 | Sannes et al. | |
| 7,678,027 | B2 | 3/2010 | Sanghavi | |
| 7,775,952 | B1 | 8/2010 | Curran | |
| D627,015 | S | 11/2010 | Senegal | |
| 7,942,796 | B2 | 5/2011 | Signorile et al. | |
| 8,353,808 | B1 | 1/2013 | Barney | |
| 8,550,965 | B2 | 10/2013 | Candela et al. | |
| 2004/0009859 | A1 | 1/2004 | Gottlieb | |
| 2004/0018924 | A1 | 1/2004 | Szydlowski et al. | |
| 2005/0209072 | A1* | 9/2005 | Sheron | 482/132 |
| 2006/0211553 | A1 | 9/2006 | Cantor | |
| 2007/0254789 | A1 | 11/2007 | Odien | |
| 2007/0298947 | A1 | 12/2007 | Eksteen | |
| 2009/0325770 | A1 | 12/2009 | Baschnagel | |
| 2010/0087301 | A1 | 4/2010 | Juncker | |
| 2010/0261590 | A1 | 10/2010 | Fares | |
| 2010/0331154 | A1* | 12/2010 | Taylor et al. | 482/142 |
| 2011/0160024 | A1* | 6/2011 | Candela et al. | 482/132 |
| 2011/0251033 | A1 | 10/2011 | Blancher | |
| 2012/0252645 | A1 | 10/2012 | Agostini | |
| 2012/0264579 | A1 | 10/2012 | Klein et al. | |
| 2013/0237395 | A1 | 9/2013 | Hjelt et al. | |

OTHER PUBLICATIONS http://www.alibaba.com/product-detail/Fitness-Jumping-Ball_255134387.html.
https://www.youtube.com/watch?v=Y9vmAEC-GuA&feature=relmfu.
www.irock360.com.
http://www.fitforallball.com/.
https://www.youtube.com/channel/UC2TAw96ujuMG6VHI-0n7TQ.
Search report issued on Mar. 5, 2015 in corresponding Singapore application.

* cited by examiner

DEVICE AND METHOD FOR PERFORMING EXERCISES USING A FREELY ROTATING BALL

CROSS-REFERENCE TO RELATED APPLICATIONS

This application relates to and claims priority from U.S. Patent Application Ser. No. 61/499,240 filed Jun. 21, 2011, the entire disclosure of which is hereby incorporated herein by reference.

FIELD OF THE DISCLOSURE

The present disclosure relates to exemplary embodiments related to apparatuses relating to a freely rotating ball and methods of use, and more particularly, to exemplary embodiments of apparatuses for performing exercises using a freely rotating ball and methods of use.

BACKGROUND INFORMATION

Athletes and other persons involved in various athletic activities frequently perform certain exercises designed and selected to strengthen various muscles of the body. There are several basic classes of such exercises, including but not limited to push-ups and planks. Push-ups are generally used to strengthen the core muscles, which can include the abdominals, back muscles and pelvic muscles.

One disadvantage of existing techniques for performing push-ups is that push-ups do not put enough strain on many of the muscles of interest, especially if the person performing the push-ups is fit or very fit, and accordingly, he or she has to repeat the exercises numerous times in order for push-ups to be effective. Also, some of the core muscles may not receive a sufficient workout during standard push-ups. Moreover, push-ups are not considered to be isometric exercises.

Planks are somewhat related to push-ups in that they can be started from similar positions. However, a person doing a plank mostly takes a preselected position and tries to hold it as long as possible. It has been found that this exercise strengthens various muscles very effectively without too much strain.

Thus, there remains a need for providing methods and apparatuses for enabling push-ups to be more effective, as well as a need for rendering planks even more effective and for performing isometric exercises.

SUMMARY OF EXEMPLARY EMBODIMENTS OF THE DISCLOSURE

At least some of the above described problems can be addressed by exemplary embodiments of the methods and apparatuses according to the present disclosure. The present disclosure provides exemplary methods and apparatuses that can provide a more effective way of performing various exercises.

For example, according to an exemplary embodiment of the present disclosure, an exercise apparatus can be provided comprising a resilient ball configured to support a weight of a user performing exercises thereon, and a shell member configured to cover at least an upper portion of the resilient ball, the shell member having an inner surface conforming to an outer surface of the resilient ball.

The exercise apparatus can further comprise a toroidal member attached to the shell member and surrounding a portion of the resilient ball. The toroidal member can be integral with the shell member. The toroidal member can surround the resilient ball below a center point of the resilient ball.

The exercise apparatus can further comprise one or more handles attached to the toroidal member for a user to grasp. The one or more handles can be provided in a plane parallel to a ground surface on which the resilient ball rests. The one or more handles can also be provided in a plane perpendicular to a ground surface on which the resilient ball rests. The one or more handles can be integral with the toroidal member, and can be attached to the toroidal member on opposite ends of the toroidal member.

The exercise apparatus can further comprise one or more platform portions attached to the toroidal member where a user's forearm or leg can rest. The one or more platform portions can be provided in a plane parallel to a ground surface on which the resilient ball rests. The one or more platform portions can be integral with the toroidal member. Two platform portions can be attached to the toroidal member on opposite ends of the toroidal member.

The resilient ball can be one of a exercise ball, medicine ball, Swiss ball, balance ball, birth ball, body ball, ball, fitness ball, gym ball, gymnastic ball, physioball, pilates ball, Pezzi ball, sports ball, stability ball, Swedish ball, therapy ball, or yoga ball. The shell member can have one or more voids within its structure to reduce weight of the shell member.

The exercise apparatus can further comprise one or more handles attached to the shell member for a user to grasp. The one or more handles can be provided in a plane parallel to a ground surface on which the resilient ball rests, and can be provided in a plane perpendicular to a ground surface on which the resilient ball rests. The one or more handles can be integral with the shell member. Two handles can be attached to the shell member on opposite ends of the shell member.

One or more platform portions can be attached to the shell member where a user's forearm or leg can rest. The one or more platform portions are provided in a plane parallel to a ground surface on which the resilient ball rests. The one or more platform portions can be integral with the shell member. Two platform portions can be attached to the shell member on opposite ends of the shell member.

The shell member can encase the upper portion of the resilient ball, and the shell member can encase at least 50% of the upper portion of the resilient ball.

According to another exemplary embodiment of the present disclosure, an exercise apparatus can be provided, comprising a shell member configured to cover at least an upper portion of a resilient ball, the shell member having an inner surface conforming to an outer surface of a resilient ball, and a toroidal member attached to a bottom portion of the shell member configured to surround a portion of the resilient ball, wherein the toroidal member is configured to be grasped by a user. The exercise apparatus can be configured to encase a variety of exercise or resilient balls, as well as different sizes of exercise or resilient balls, such as by providing various locking mechanisms.

According to another exemplary embodiment of the present disclosure, an exercise apparatus can be provided, comprising a resilient ball configured to support a weight of a user performing exercises thereon, a shell member configured to encase at least 50% of an outer surface of the resilient ball such that the resilient ball cannot be detached from the shell member by lifting the shell member, the shell member having an inner surface conforming to an outer surface of the resilient ball and being slidable relative thereto, a toroidal member attached to the shell member configured to surround a portion of the resilient ball, and at least two handles attached to the toroidal member on substantially opposite sides for a user to grasp.

BRIEF DESCRIPTION OF THE DRAWINGS

The foregoing and other objects of the present disclosure will be apparent upon consideration of the following detailed description, taken in conjunction with the accompanying drawings and claims, in which like reference characters refer to like parts throughout, and in which:

Figure 1:
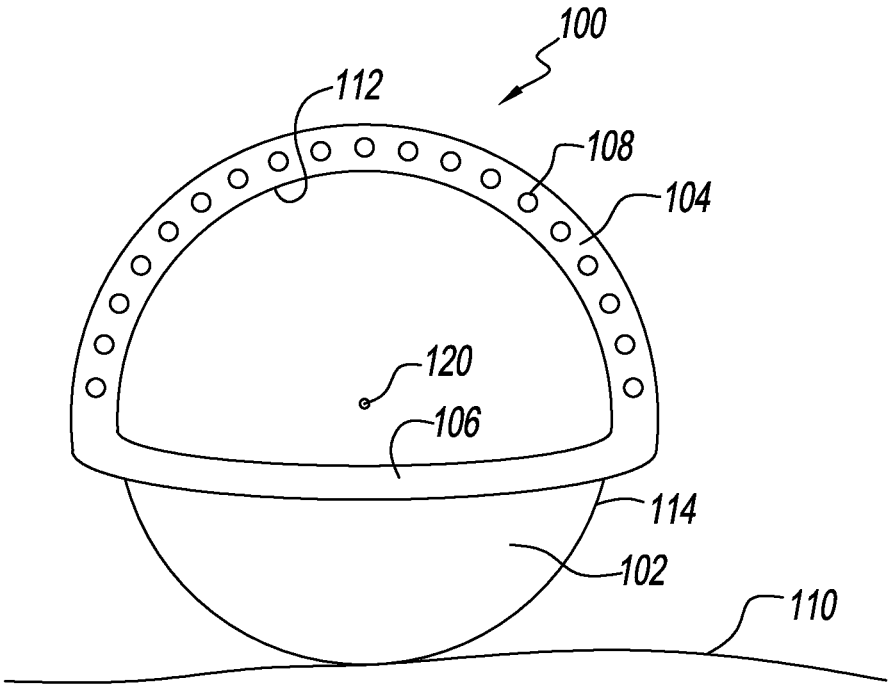
FIG. 1 illustrates an exercise apparatus according to an exemplary embodiment of the present disclosure.

Throughout the figures, the same reference numerals and characters, unless otherwise stated, are used to denote like features, elements, components or portions of the illustrated embodiments. Moreover, while the subject disclosure will now be described in detail with reference to the figures, it is done so in connection with the illustrative embodiments. It is intended that changes and modifications can be made to the described embodiments without departing from the true scope and spirit of the subject disclosure.

DETAILED DESCRIPTION OF EXEMPLARY EMBODIMENTS OF DISCLOSURE

Exemplary embodiments of the methods and systems according to the present disclosure will be described herein. The methods and systems according to the exemplary embodiments of the present disclosure can provide for an exercise apparatus, its method of manufacture and use. The exercise apparatus according to exemplary embodiments can be used for a variety of exercises, such as planks and push-ups.

FIG. 1 illustrates an exercise apparatus 100 according to an exemplary embodiment of the present disclosure. An exercise apparatus 100 can have a resilient ball 102 that can be configured to support a weight of a user for performing exercises thereon. The resilient ball 102 can be a spherical or round shape, or can have other shapes that are configured so that the resilient ball 102 can rotate. For example, a round shape will allow the resilient ball 102 to rotate in all axes, while an oblong or elliptical shape will allow the resilient ball to rotate in a single axis. The exemplary embodiments of the present disclosure are not limited to any particular shape.

The resilient ball 102 can be made of various materials, such as plastic or elastic, or can have an outer cloth, such as a leather or vinyl covered nylon cloth, and can be filled with an impact absorbing material, such as sand. The resilient ball 102 can preferably be made of a strong material so that it can support the weight of a person and other forces without any substantial distortion or deformation. The resilient ball 102 can be of any size, and preferably can have a diameter of approximately ten to approximately twelve inches. The resilient ball 102 can also be hollow in a middle portion to reduce its weight if desired. The resilient ball 102 can be any type of ball, such as an exercise ball, medicine ball, Swiss ball, balance ball, birth ball, body ball, ball, fitness ball, gym ball, gymnastic ball, physioball, pilates ball, Pezzi ball, sports ball, stability ball, Swedish ball, therapy ball, or yoga ball. The resilient ball 102 is not restricted to any type of ball, material or construction.

The exercise apparatus 100 can have a shell member 104 that can be configured to cover at least an upper portion of the resilient ball 102 with respect to the surface 110. For example, the shell member 104 can surround at least 50% of a perimeter of the resilient ball 102 with respect to the surface 110, such that when the shell member 104 is lifted, the resilient ball 102 is also lifted because the resilient ball 102 is held by the shell member 104. For example, the shell member 104 can extend below the center 120 of the resilient ball 102 such that it covers more than 50% of a perimeter of the resilient ball 102. In this manner, the resilient ball 102 can be captured by the shell member and cannot be removed from it. The shell member 104 can have voids 108 (e.g., holes) within its structure to reduce weight of the shell member 104.

Figure 2:
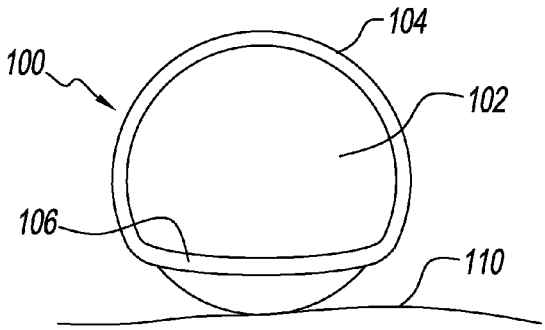
FIG. 2 illustrates an exercise apparatus according to another exemplary embodiment of the present disclosure.

In an exemplary embodiment of the present disclosure, the shell member covers 50%-85% of a perimeter of the resilient ball 102. For example, as shown in FIG. 2, a shell member 104 can be provided that can cover a majority of a perimeter of the resilient ball 102. The shell member 104 can also have a solid structure (i.e., no voids 108).

Figure 3:
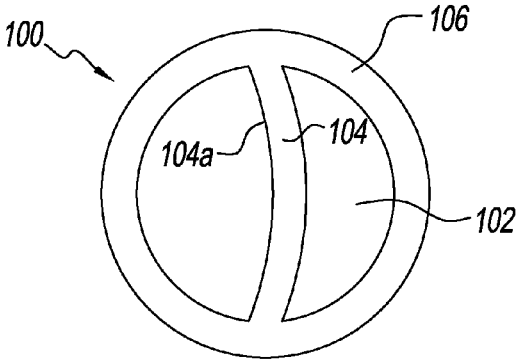
FIG. 3 illustrates a top view of an exercise apparatus according to an exemplary embodiment of the present disclosure.
Figure 4:
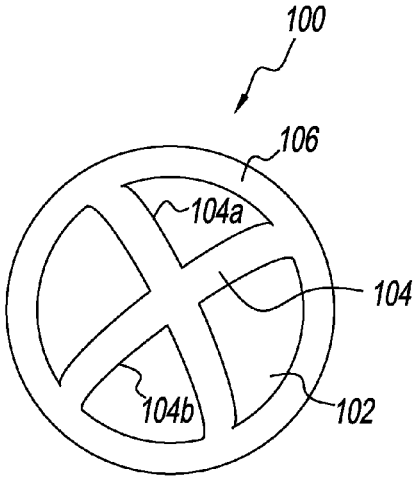
FIG. 4 illustrates a top view of an exercise apparatus according to another exemplary embodiment of the present disclosure.
Figure 5:
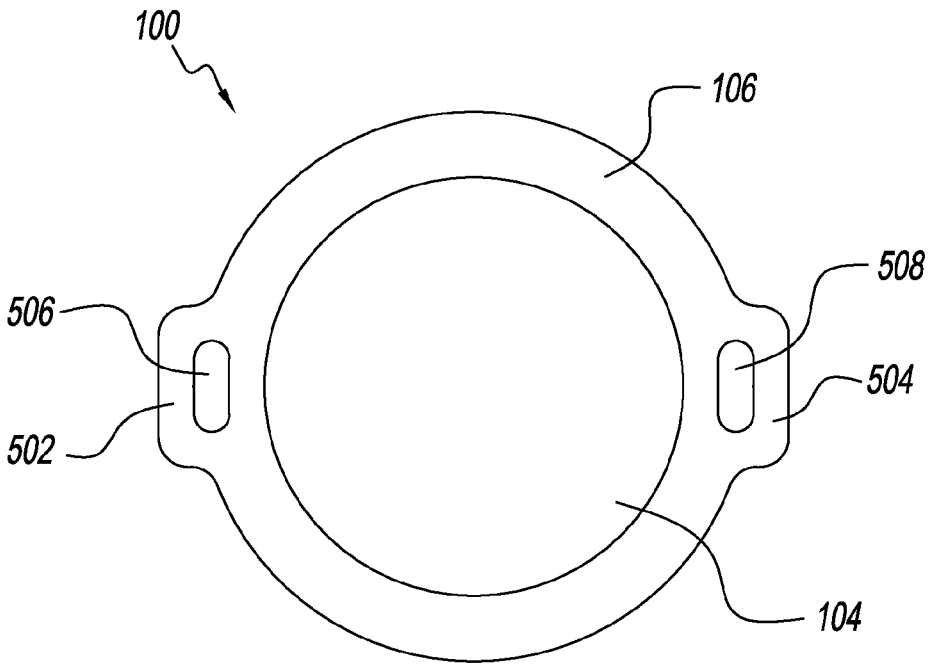
FIG. 5 illustrates a top view of an exercise apparatus according to another exemplary embodiment of the present disclosure.

The shell member 104 can have different configurations. For example, FIG. 3 illustrates a top view of an exercise apparatus 100 according to an exemplary embodiment of the present disclosure, where the shell member 104 has a configuration where a single member 104*a* runs across from side to side of the resilient ball 102. FIG. 4 illustrates a top view of an exercise apparatus 100 according to an exemplary embodiment of the present disclosure, where the shell member 104 has an "X" configuration where members 104*a* and 104*b* run across from side to side of the resilient ball 102. FIG. 5 illustrates a top view of an exercise apparatus 100 according to another exemplary embodiment of the present disclosure, where the shell member 104 can completely encase an upper portion of the resilient ball 102.

The shell member 104 can be made of a plastic, wood or metal material, and is not restricted to any particular weight. The shell member 104 can have an inner surface 112 conforming to an outer surface 114 of the resilient ball 102, so that these surfaces can contact each other. The materials of the resilient ball 102 and shell member 104 can be selected to insure that there is substantially no friction between them, such that the resilient ball 102 can be free to rotate in any direction with respect to the shell member 104. The shell member 104 can have holes or voids 108 to reduce its weight (and therefore, a weight of the exercise apparatus 100), or it can be solid. Preferably, the resilient ball 102 and shell member 104 can be made of a plastic and lightweight material. In an exemplary embodiment of the present disclosure, a lubricant can be applied between the outer surface 114 of the resilient ball 102 and the inner surface 112 of the shell member 104 so that the resilient ball 102 can rotate smoothly in any direction with respect to the shell member 104.

As shown in FIGS. 1-5, the exercise apparatus 100 according to an exemplary embodiment of the present disclosure can have a shell member 104 having a toroidal member 106 that can surround a portion of the resilient ball 102. The toroidal member 106 can be attached to the shell member 104 or can be integral with the shell member 104. The toroidal member 106 can be provided along the center of the resilient ball 102, or partially below the center 120 of the resilient ball 102, as shown in FIG. 1. In another exemplary embodiment of the present disclosure, the toroidal member 106 can be provided approximately slightly above a surface 110 when the resilient ball 102 is placed on the surface 110, as shown in FIG. 2. For example, if the resilient ball 102 has a diameter of approximately twelve inches, the toroidal member 106 can be approximately two to six inches above the surface 110 on which the resilient ball 102 rests, and preferably approximately three to five inches above the surface 110.

The toroidal member 106 can be attached to the shell member 104 along a bottom portion of the shell member 104 as illustrated in FIGS. 1 and 2. In other exemplary embodiments of the present disclosure, the toroidal member 106 may be provided higher than the bottom portion of the shell member 104, and can preferably be provided anywhere between the center point 120 of the resilient ball 102 and the surface 110 when the resilient ball 102 is placed on the surface 110. The toroidal member 106 may have a circular shape to surround the resilient ball 102, and can have different cross sections, such as circular, square, rectangular, triangular, etc., and is not restricted to any particular shape or cross section.

As shown in FIG. 5, the toroidal member 106 can have one or more handles 502, 504 that can be attached or integral with the toroidal member 106. The handles 502, 504 can be provided in a plane that can be parallel to the ground surface 110 when the resilient ball 102 is placed on the surface 110. The handles 502, 504 can be provided for a user to grasp when performing exercises. Lifting the exercise apparatus 100 using the handles 502, 504 can cause the resilient ball 102 to also lift upwards based on the structure described above. The handles 502, 504 can be disposed diametrically across the shell member 104 provided on opposite ends of the resilient ball 102, and can have holes 506, 508 allowing a user's fingers to go through when grasping the handles 502, 504.

Figure 6:
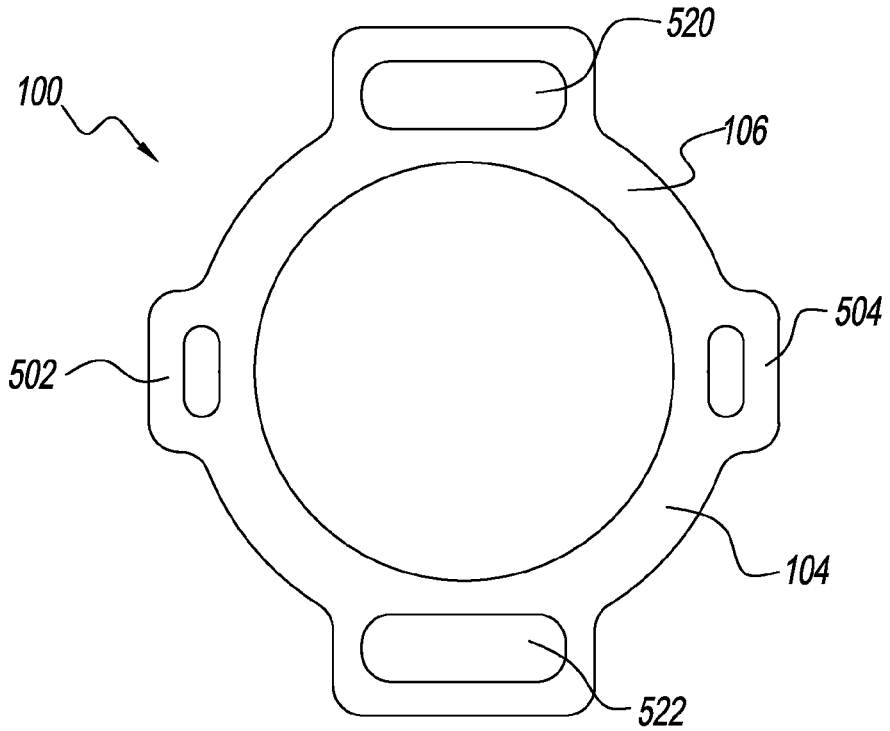
FIG. 6 illustrates a top view of an exercise apparatus according to another exemplary embodiment of the present disclosure.

FIG. 6 illustrates a top view of an exercise apparatus 100 according to another exemplary embodiment of the present disclosure, where the toroidal member 106 has platform portions 520, 522 that can be disposed diametrically across the shell member 104 provided on opposite ends of the resilient ball 102. The platform portions 520, 522 can allow a user's forearms or legs to rest on, or for feet to stand on, when using the exercise apparatus 100 for an exercise. The platform portions 520, 522 can be provided in a plane parallel to a ground surface 110 when the resilient ball 102 rests on the surface 110. The platform portions 520, 522 can be attached to the toroidal member 106 or can be integral with the toroidal member 106.

In exemplary embodiments of the present disclosure, the handles 502, 504 and/or the platform portions 520, 522 can be provided on the toroidal member 106, or can be provided directly connected to the shell member 104. In some exemplary embodiments of the present disclosure, the shell member 104 can be provided by itself (which can contain handles 502, 504 and/or the platform portions 520, 522), or can be provided with the toroidal member 106 (which can contain handles 502, 504 and/or the platform portions 520, 522), without the resilient ball 102. These apparatuses can be configured to be placed on top of any resilient ball (such as an exercise ball or medicine ball or any other kind of ball). One skilled in the art would understand this would require some type of connection such that the resilient ball does not displace itself from the shell member 104 and/or toroidal member 106.

Figure 7:
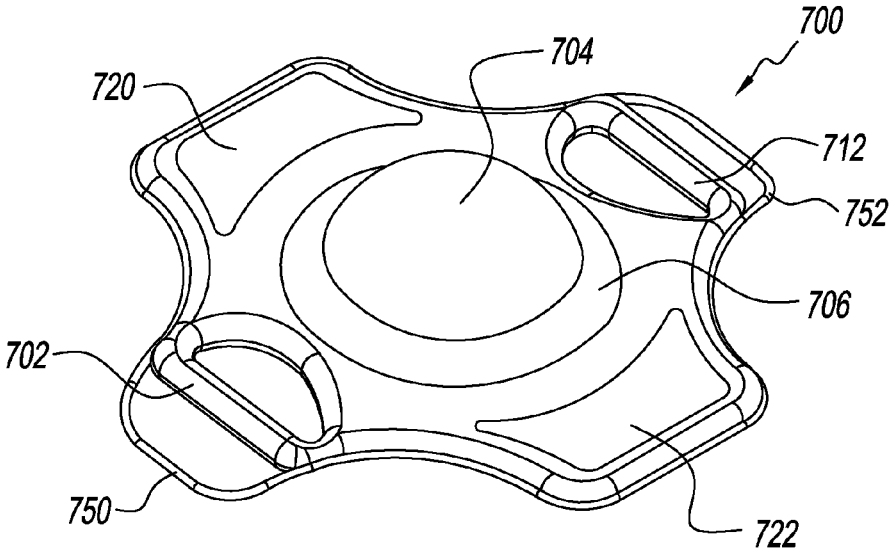
FIG. 7 illustrates an exercise apparatus according to another exemplary embodiment of the present disclosure.

The exercise apparatus can have various different configurations in the exemplary embodiments of the present disclosure. For example, FIG. 7 illustrates an exercise apparatus 700 according to another exemplary embodiment of the present disclosure, where a shell member 704 encases an upper portion of the resilient ball. The shell member 704 can encase at least 50% of an upper portion of the resilient ball. A toroidal member 706 can be provided around the resilient ball. Handles 702, 712 can be provided on opposite ends of the toroidal member 706 or shell member 704, and platform portions 720, 722 can be provided on opposite ends of the toroidal member 706 or shell member 704. The handles 702, 712 and/or platform portions 720, 722 can be attached to the toroidal member 706 or shell member 704, or can be integral with the toroidal member 706 or shell member 704. The handles 702, 712 and/or platform portions 720, 722 can be provided in a plane parallel to a ground surface on which the resilient ball rests. Knuckle guards 750, 752 can also be provided along handles 702, 712 in case a user's grip may slip, preventing injury to the knuckles.

Figure 8:
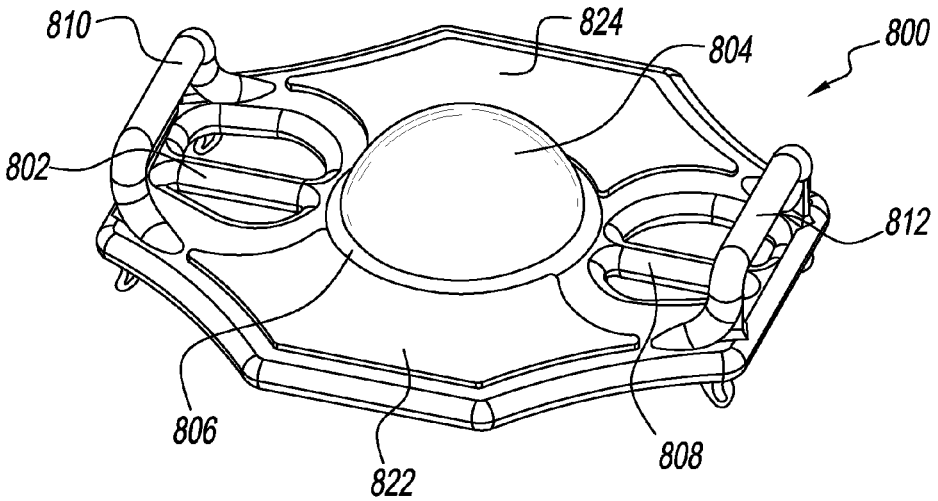
FIG. 8 illustrates an exercise apparatus according to another exemplary embodiment of the present disclosure.
Figure 9:
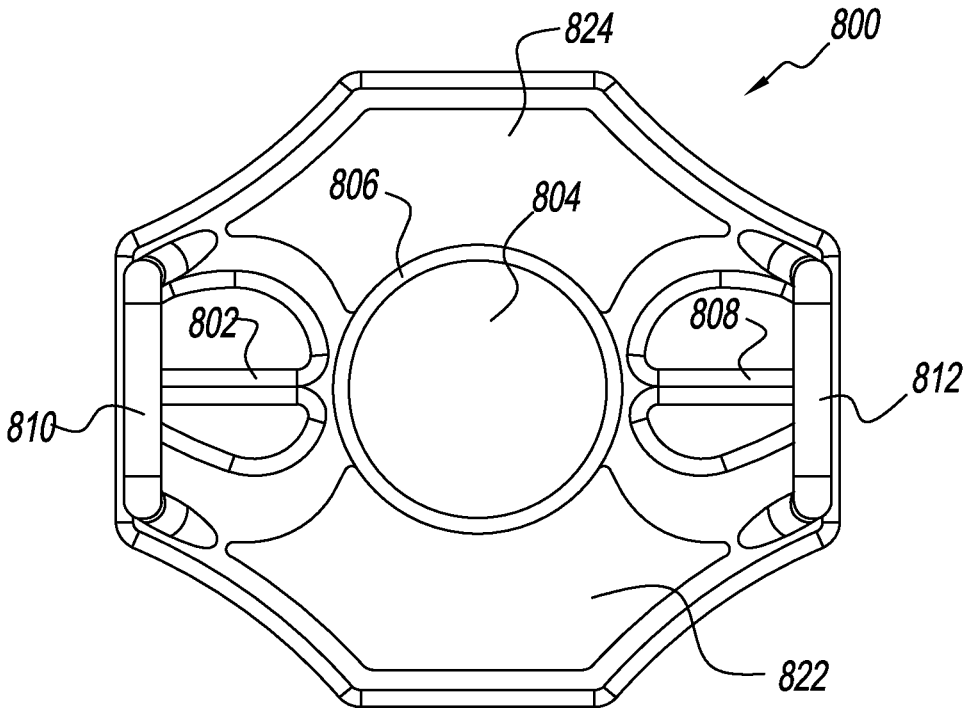
FIG. 9 illustrates a top view of the exercise apparatus according to the exemplary embodiment of FIG. 8.
Figure 10:
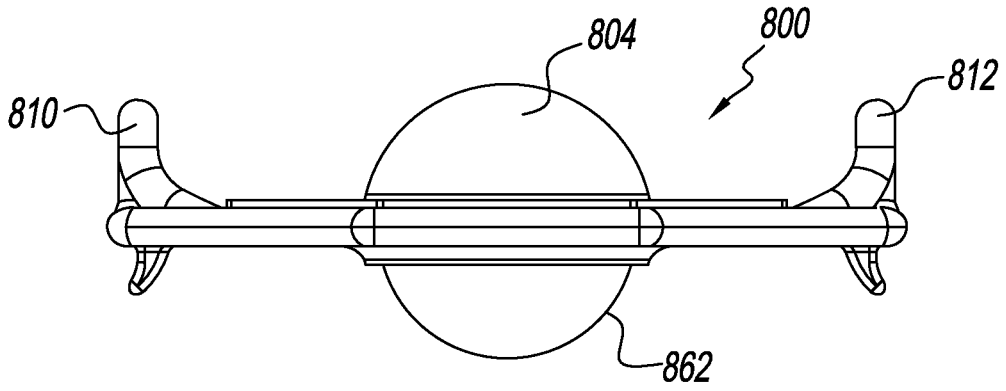
FIG. 10 illustrates a front view of the exercise apparatus according to the exemplary embodiment of FIG. 8.

FIG. 8 illustrates an exercise apparatus 800 according to another exemplary embodiment of the present disclosure, where handles 802, 808 can be provided on opposite ends of the shell member 804 and/or toroidal member 806, and platform portions 822, 824 can be provided on opposite ends of the shell member 804 and/or toroidal member 806. Additional handles 810, 812 can be provided on opposite ends of the shell member 804 and/or toroidal member 806, which can be provided in a plane perpendicular to a ground surface on which the resilient ball rests, and/or perpendicular to the plane of the handles 802, 808. These handles 810, 812 can be provided in addition to handles 802, 808, or can be provided in their stead. Various configurations can be provided for handles 802, 808 and 810, 812, such that different exercises can be performed and different muscles can be exercised. For example, a user would grip the handles 702, 712 of FIG. 7 in a different alignment than the handles 802, 808 of FIG. 8. The user can grip the handles 702, 712 such that the handles 702, 712 would be parallel to a direction of the head to the foot of the user, and the user can grip the handles 812, 808 in a direction perpendicular to a direction of the head to the foot of the user. The handles 810, 812 can be provided on the same sides as platform portions 822, 824, or on the same sides as handles 802, 808 as illustrated in FIG. 9, which illustrates a top view of the exemplary embodiment of FIG. 8. Different types of handles can also be provided according to exemplary embodiments of the present disclosure, such as handles that can turn and can have a locking mechanism included. FIG. 10 illustrates a front view of the exercise apparatus 800 of FIG. 8, with the showing an upper portion of the resilient ball 802 encased by the shell member 804, and handles 810, 812.

Figure 11:
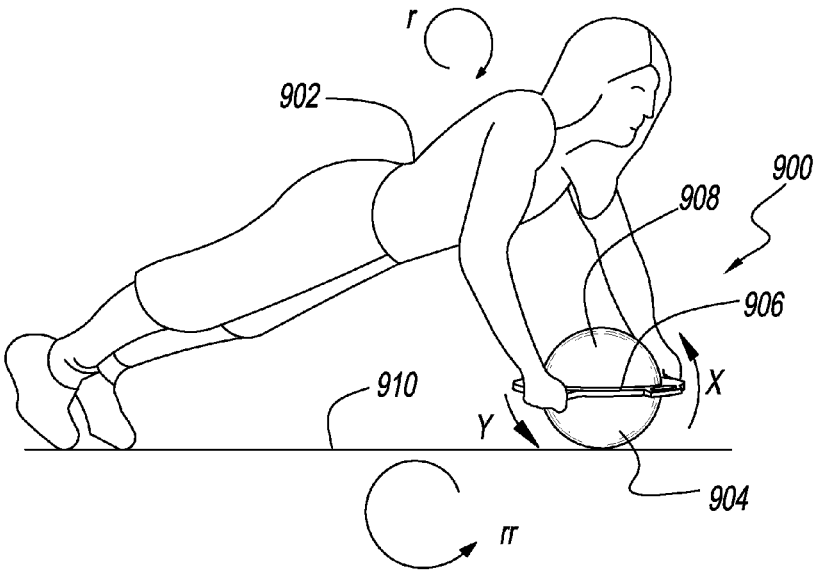
FIG. 11 illustrates a user using the exercise apparatus according to exemplary embodiments of the present disclosure with its hands.

The exemplary embodiments of the present disclosure can provide for different configurations of the exercise apparatus, and can provide for various types of exercises. For example, FIG. 11 illustrates a user 902 using the exercise apparatus 900 described in some of the exemplary embodiments of the present disclosure with his/her hands. The user 902 can place his hands along the handles of the exercise apparatus 900, which can be located on opposite ends of the toroidal member 906. The resilient ball 904 can be placed on the surface 910, and a shell member 908 can encase an upper portion of the resilient ball 902. The user 902 can perform push-ups using the exercise apparatus 900, or can perform a standard plank. The exercise apparatus can be very unstable in this position because the shell member 908 can have the tendency to rotate around the resilient ball 904 in a direction x or y, and, at the same time, the resilient ball 904 can have the tendency to move in a direction r or direction rr by rolling on the ground surface 910. The user 902 can compensate for any small movement of either the shell member 908 or the resilient ball 904 by adjusting his/her equilibrium. This exercise can strengthen the core muscles. This operation by the user 902 can make the plank exercise much more intense and challenging as compared to a traditional plank. If desired, the user 902 can also perform a pushup by pivoting his body up and down, which will be much more difficult than a standard push-up. The person can also move the exercise apparatus 900 by a small amount in any direction (i.e., x, y, r or rr), thereby strengthening the muscles of the body, such as the arms and/or shoulders.

Figure 12:
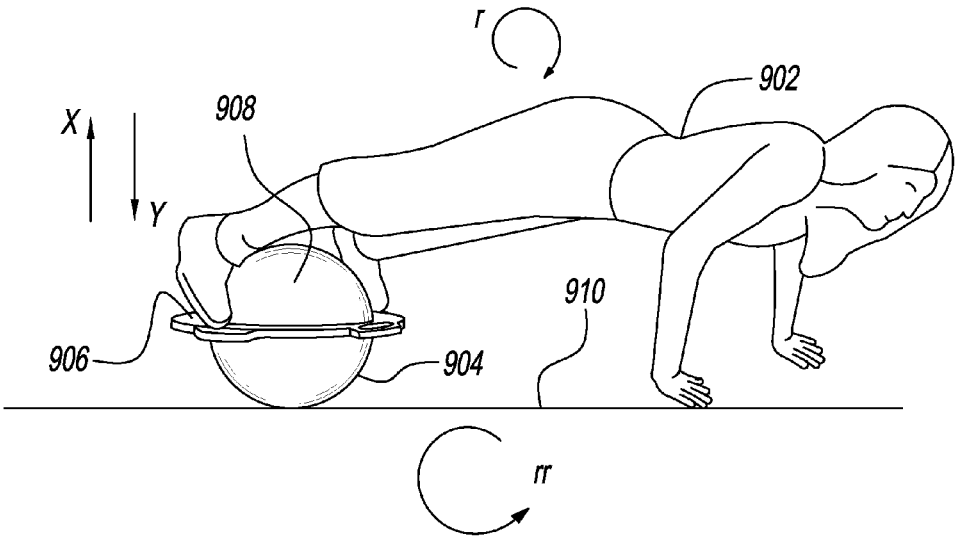
FIG. 12 illustrates a user using the exercise apparatus according to exemplary embodiments of the present disclosure with its feet.

FIG. 12 illustrates a user 902 using the exercise apparatus 900 described in some of the exemplary embodiments of the present disclosure with his/her feet. During this exercise, the user 902 can rest his hands on the ground surface 910, and his/her feet can engage the platform portions of the exercise apparatus 900. Straps can be provided on the platform portions to engage the feet of the user 902. For this exercise, equilibrium can be achieved by adjusting the positions of the feet, legs and the rest of the lower body, and this exercise can strengthen the abdominal muscles. The exercise can also be done with the elbows of the user 902 resting on the surface 910. The user 902 can also perform push-ups in this position.

Various other exercises are possible using the exercise apparatus according to exemplary embodiments of the present disclosure, and are not limited by the above. One skilled in the art would understand the different types of exercises that may be performed. For example, in some embodiments, the user can stand on the platform portions of the exercise device and perform squats (e.g., the user can move his weight to one leg such that the bottom portion of one platform portion touches the ground while the other opposite end and other foot are off the surface, and perform a squat exercise). All different exercises that may be performed do not need to be described in the specification.

Figure 13:
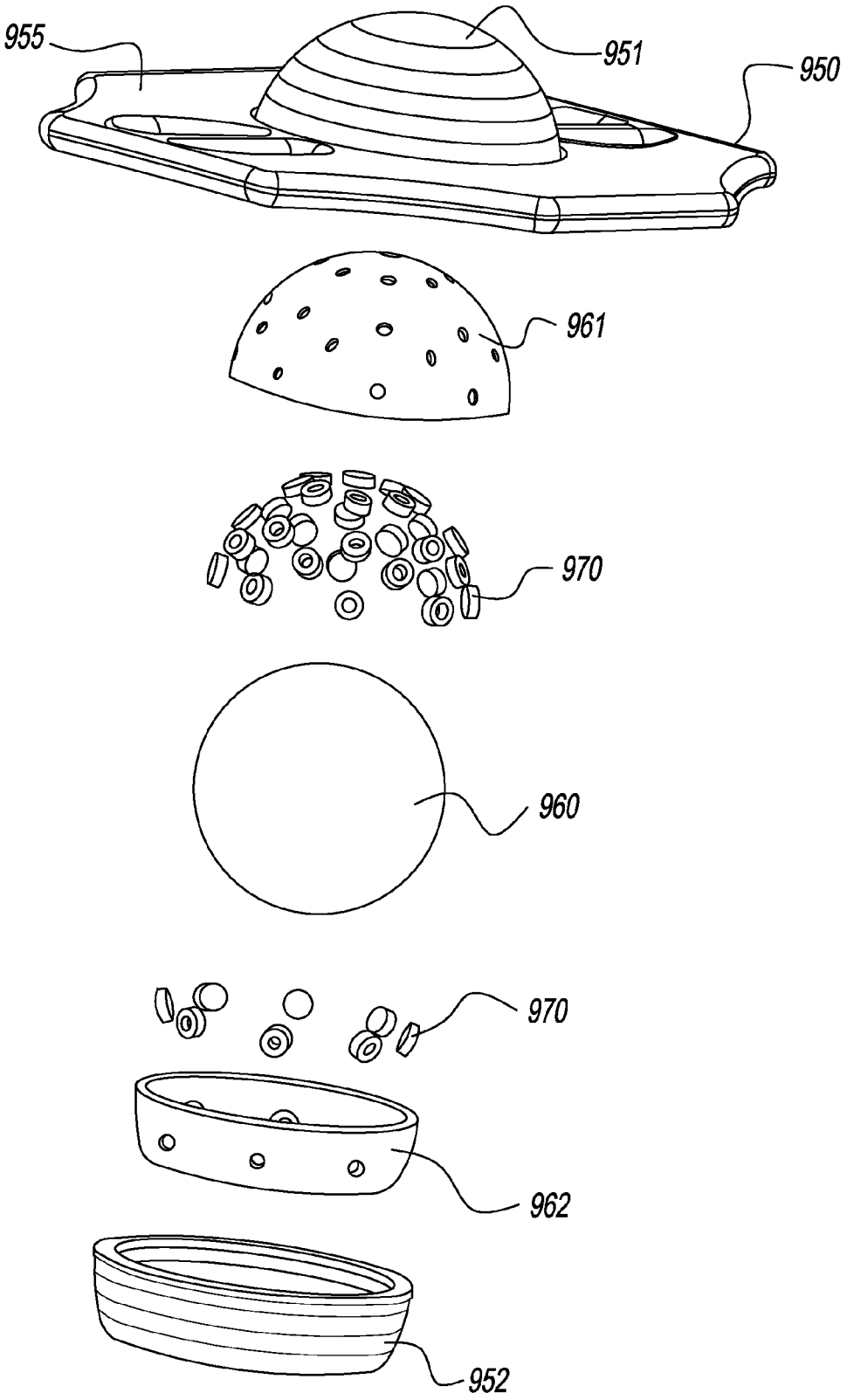
FIG. 13 illustrates a blown up view of the exercise apparatus according to exemplary embodiments of the present disclosure.

Various different methods of manufacture can be provided for the exemplary embodiments of the present disclosure. FIG. 13 illustrates a blown up view of the exercise apparatus according to exemplary embodiments of the present disclosure. As shown in FIG. 13, a platform 950 can be provided. The platform 950 can comprise a shell member, toroidal member 955, and handles and/or platform portions as described above. The shell member can have a top section 951 and a bottom section 952, such that the top section 951 is placed on top of a resilient ball 960, and the bottom section 952 is placed below the resilient ball 960. The bottom section 952 can hold the resilient ball 960 in place when a user picks up the platform 950 once the exercise apparatus is assembled. The bottom section 960 can be attached to the top section 951 or platform 950 by a number of different methods, such as screws, nails, clips, pins, etc. and are not limited to any such mechanisms. Easily removable devices such as pins can be used to allow for easy assembly/disassembly to apply the platform 950 on different resilient balls.

A containing ring can be provided having an upper portion 961 between an upper surface of the resilient ball 960 and the top section 951 of the platform 950, and a lower portion 962 between the resilient ball 960 and the bottom section 952. The upper portion 961 and lower portion 961 can have one or more holes within their structure to reduce their weight. The containing rings can be used to provide one or more friction reducing skid pads 970 between the resilient ball 960 and upper portion 961 and lower portion 962, to allow the resilient ball to slide relative to the containing ring. The upper portion 961 can be attached to the top section 951, and the lower portion 962 can be attached to the bottom section 952.

The platform 950 can be manufactured using a number of different processes according to exemplary embodiments of the present disclosure. The platform 950 can be cast molded, injection molded, and/or machined. The placement areas for the friction reducing skid pads 970 can be incorporated in the platform 950 during this process. The platform 950 can be made of a number of different materials. For example, it can be made of fiber glass, carbon fiber, wood, plastic, a composite or any of a number of materials, and is not limited to such materials. The friction reducing skid pads 970 can be made of Teflon® or any other type of friction reducing material. The skid pads 970 can either be machined or compression molded. The resilient ball 960 can be made from composite materials or resin similar to that of a bowling ball. The containing ring can be made from the same materials as the platform 950, and can use similar manufacturing processes.

The platform 950 can be assembled with inserts for the skid pads 970. Once the skid pads 970 are inserted, the resilient ball 960 can be placed within a ball housing space of the platform 950. The resilient ball 960 can then be encased and fixed to the platform 950 by the containing ring 961, 962. The containing ring 961, 962 can be fixed to the platform by using a number of different methods.

The exemplary embodiments of the present disclosure provide advantages over the exercise devices and methods used in the prior art. For example, planks and push-ups can be performed using the exemplary embodiments of the present disclosure that require a higher degree of stamina, and can strengthen the core appreciably more than standard planks and push-ups. The exercise apparatus according to various aspects of the present disclosure can incorporate a resilient ball configured to support the weight of a user. A conventional exercise ball can be quickly and easily modified into an exercise apparatus according to the present disclosure by coupling it with a shell member or with a shell and toroidal member. The exercise apparatus facilitates effective strength training in addition to the development of flexibility, balance, coordination, and stability. The exercise apparatus can be relatively inexpensive and simple to use, and it can be employed in a versatile manner to perform a number of different exercise movements.

The foregoing merely illustrates the principles of the disclosure. Various modifications and alterations to the described embodiments will be apparent to those skilled in the art in view of the teachings herein. It will thus be appreciated that those skilled in the art will be able to devise numerous systems, arrangements, manufacture and methods which, although not explicitly shown or described herein, embody the principles of the disclosure and are thus within the spirit and scope of the disclosure. In addition, to the extent that the prior art knowledge has not been explicitly incorporated by reference herein above, it is explicitly being incorporated herein in its entirety. All publications referenced herein above are incorporated herein by reference in their entireties, as applicable. In the event of a conflict between the teachings of the present disclosure and those of the incorporated document, the teachings of the present disclosure control.

What is claimed is:

1. An exercise apparatus comprising:

a resilient ball configured to support a weight of a user performing exercises thereon;

a shell member configured to cover at least a topmost portion of the resilient ball, the shell member having an inner surface conforming to an outer surface of the resilient ball, wherein the inner surface of the shell member is configured to allow the resilient ball to roll relative to the shell member when the shell member is pressed against the resilient ball by the weight of the user;

a toroidal member that surrounds an outer surface of the shell member below the topmost portion of the resilient ball and extends from the outer surface of the shell member in a direction away from the resilient ball;

at least one handle fixed to the toroidal member and configured for the user to grasp; and at least one platform portion fixed to the toroidal member and configured for a forearm, leg or foot of the user to be placed thereon.

2. The exercise apparatus of claim 1, wherein the toroidal member is integral with the shell member.

3. The exercise apparatus of claim 1, wherein the toroidal member surrounds the resilient ball below a center point of the resilient ball.

4. The exercise apparatus of claim 1, wherein the at least one handle comprises two handles attached to the toroidal member each on opposite ends of the toroidal member.

5. The exercise apparatus of claim 4, wherein the two handles are provided in a plane parallel to a ground surface on which the resilient ball rests.

6. The exercise apparatus of claim 4, wherein the two handles are provided in a plane perpendicular to a ground surface on which the resilient ball rests.

7. The exercise apparatus of claim 4, wherein the two handles are integral with the toroidal member.

8. The exercise apparatus of claim 1, wherein two platform portions are attached to the toroidal member each on opposite ends of the toroidal member.

9. The exercise apparatus of claim 8, wherein the platform portions are provided in a plane parallel to a ground surface on which the resilient ball rests.

10. The exercise apparatus of claim 8, wherein the platform portions are integral with the toroidal member.

11. The exercise apparatus of claim 1, wherein the resilient ball is an exercise ball, medicine ball, sports ball, or stability ball.

12. The exercise apparatus of claim 1, wherein the shell member has one or more voids within its structure to reduce weight of the shell member.

13. The exercise apparatus of claim 1, wherein the shell member covers at least 50% of the resilient ball.

14. An exercise apparatus comprising:

a shell member configured to cover at least a topmost portion of a resilient ball, the shell member having an inner surface conforming to an outer surface of the resilient ball, wherein the inner surface of the shell member is configured to allow the resilient ball to roll relative to the shell member when the shell member is pressed against the resilient ball by a weight of a user;

a toroidal member attached to and surrounding a bottom portion of the shell member below the topmost portion of the resilient ball, the toroidal member extending from an outer surface of the shell member in a direction away from the resilient ball;

at least one handle fixed to the toroidal member and configured for a the user to grasp;

and at least one platform portion fixed to the toroidal member and configured for a forearm, leg or foot of the user to be placed thereon.

15. The exercise apparatus of claim 14, wherein the at least one handle comprises two handles attached to the toroidal member each on opposite ends of the toroidal member.

16. The exercise apparatus of claim 15, wherein the two handles are integral with the toroidal member.

17. The exercise apparatus of claim 14, wherein the at least one platform portion comprises two platform portions attached to the toroidal member each on opposite ends of the toroidal member.

18. The exercise apparatus of claim 17, wherein the two platform portions are integral with the toroidal member.

19. An exercise apparatus comprising:

a resilient ball configured to support a weight of a user performing exercises thereon;

a shell member configured to encase at least 50% of an outer surface of the resilient ball such that the resilient ball cannot be detached from the shell member by lifting the shell member, the shell member having an inner surface conforming to an outer surface of the resilient ball and being configured to allow the resilient ball to roll relative to the shell member when the shell member is pressed against the resilient ball by the weight of the user;

a toroidal member attached to and surrounding an outer surface of the shell member below a top portion of the resilient ball, the toroidal member extending from the outer surface of the shell member in a direction away from the resilient ball;

at least two handles fixed to the toroidal member on substantially opposite sides for a the user to grasp; and at least two platform portions fixed to the toroidal member on substantially opposite sides and configured for a forearm, leg or foot of the user to be placed thereon.

20. The exercise apparatus of claim 19, wherein the at least two handles are integral with the toroidal member.

21. The exercise apparatus of claim 19, wherein the at least two platform portions are integral with the toroidal member.

* * * * *